US005202648A

United States Patent [19]

McCandless

[11] Patent Number: 5,202,648

[45] Date of Patent: Apr. 13, 1993

[54] HERMETIC WAVEGUIDE-TO-MICROSTRIP TRANSITION MODULE

[75] Inventor: Jay H. McCandless, Issaquah, Wash.

[73] Assignee: The Boeing Company, Seattle, Wash.

[21] Appl. No.: 804,305

[22] Filed: Dec. 9, 1991

[51] Int. Cl.[5] ..... H01P 5/107

[52] U.S. Cl. ..... 333/26; 333/33

[58] Field of Search ..... 333/21 R, 26, 33

[56] References Cited

U.S. PATENT DOCUMENTS 4,550,296 10/1985 Ehrlinger et al. ..... 333/26

5,045,820 9/1991 Leicht et al. ..... 333/26

FOREIGN PATENT DOCUMENTS 230701 11/1985 Japan ..... 333/26

OTHER PUBLICATIONS

R. G. Beaudette et al., "Waveguide-to-Microstrip Transitions", *Microwave Journal*, pp. 211-215, Sep. 1989.

T. H. Oxley et al., "mm-Wave (30-110 GHz) Hybrid Microstrip Technology", *Microwave Journal*, pp. 36-44, Mar. 1986.

A. K. Sharma, "Tunable Waveguide-to-Microstrip Transition for MMW Applications", 1987 *IEEE MTT-S Digest*, pp. 353-356.

*Primary Examiner*—Paul Gensler

*Attorney, Agent, or Firm*—Kenneth J. Cooper

[57] ABSTRACT

A waveguide-to-microstrip transition module transmits captured electromagnetic energy between a waveguide and signal processing circuitry. The module is an assembly of a base which includes at least one waveguide, a circuit board having one side mounted to the base and the opposite side including at least one microstrip. The microstrip is simultaneously connected to signal processing circuitry and oriented with each waveguide. A backshort is associated with each microstrip. The module further includes a housing bonded to and containing, the base and circuit board. A cover is hermetically sealed to the housing to enclose the circuit board in the housing.

6 Claims, 3 Drawing Sheets

HERMETIC WAVEGUIDE-TO-MICROSTRIP TRANSITION MODULE

SUMMARY OF THE INVENTION

Waveguide-to-microstrip transitions for processing 8 millimeter wave electromagnetic signals have been refined and miniaturized for high performance. The challenge has become designing such a transition into a modular, repeatably manufacturable package which minimizes manufacturing costs while maximizing the transition performance. Hermetically sealing the transition prevents moisture accumulation within the package and prolongs circuitry life.

Existing waveguide-to-microstrip transitions have one of three designs. Some use a coaxial cable with the centerline wire performing as an electromagnetic field probe into a waveguide as described in "Waveguide-to-Microstrip Transitions" in the September 1989 issue of the *Microwave Journal*. The body of the coaxial cable extends through the wall of the package so one end of the cable protrudes into the waveguide while the other end of the coaxial cable centerline is bonded to the signal processing circuitry. This approach is deficient because the coaxial cable is difficult to hermetically seal unless the dielectric is glass. The drawback to glass, though, is that only a narrow band of electromagnetic signals will be transmitted from the waveguide outside the transition, through the coaxial centerline cable, and to the signal processing circuitry inside the transition package. Additionally, the hole through which the coaxial cable passes must be precisely machined and hand assembled for proper positioning of the coaxial insert onto the signal processing circuitry and in the waveguide.

A second form of waveguide-to-microstrip transitions includes a sealed waveguide. The seal for the waveguide must be a dielectric to transmit electromagnetic signals. This dielectric, however, as with the coaxial cable design, allows only a narrow band of electromagnetic signals into the waveguide for pick-up by a waveguide probe and transmission to signal processing circuitry. This approach to a hermetic transition design allows the transition itself to be non-hermetic, but the lossy dielectric waveguide window and hand assembly of the transition make the design impractical. This design is disclosed in the March 1986 issue of the *Microwave Journal*, "mm-Wave (30–110 GHz) Hybrid Microstrip Technology."

A third design is disclosed in the *IEEE MTT-S Digest*, 1987 article entitled "Tunable Waveguide-To-Microstrip Transition." This design has an electromagnetic field probe mounted on a quartz substrate. The substrate is mounted over the waveguide and an adjustable screw forms an adjustable backshort for the waveguide. The quartz substrate is hermetically sealed to the waveguide and the package containing the signal processing circuitry. Drawbacks to this design include hand tuning of the waveguide by turning the adjustable screw to maximize the pick-up of the electromagnetic signal probe in the waveguide, considerable hand assembly, and some electromagnetic signal energy loss because of the gaps between the moveable backshort surface and the waveguide sidewalls.

DETAILED DESCRIPTION

Figure 1:
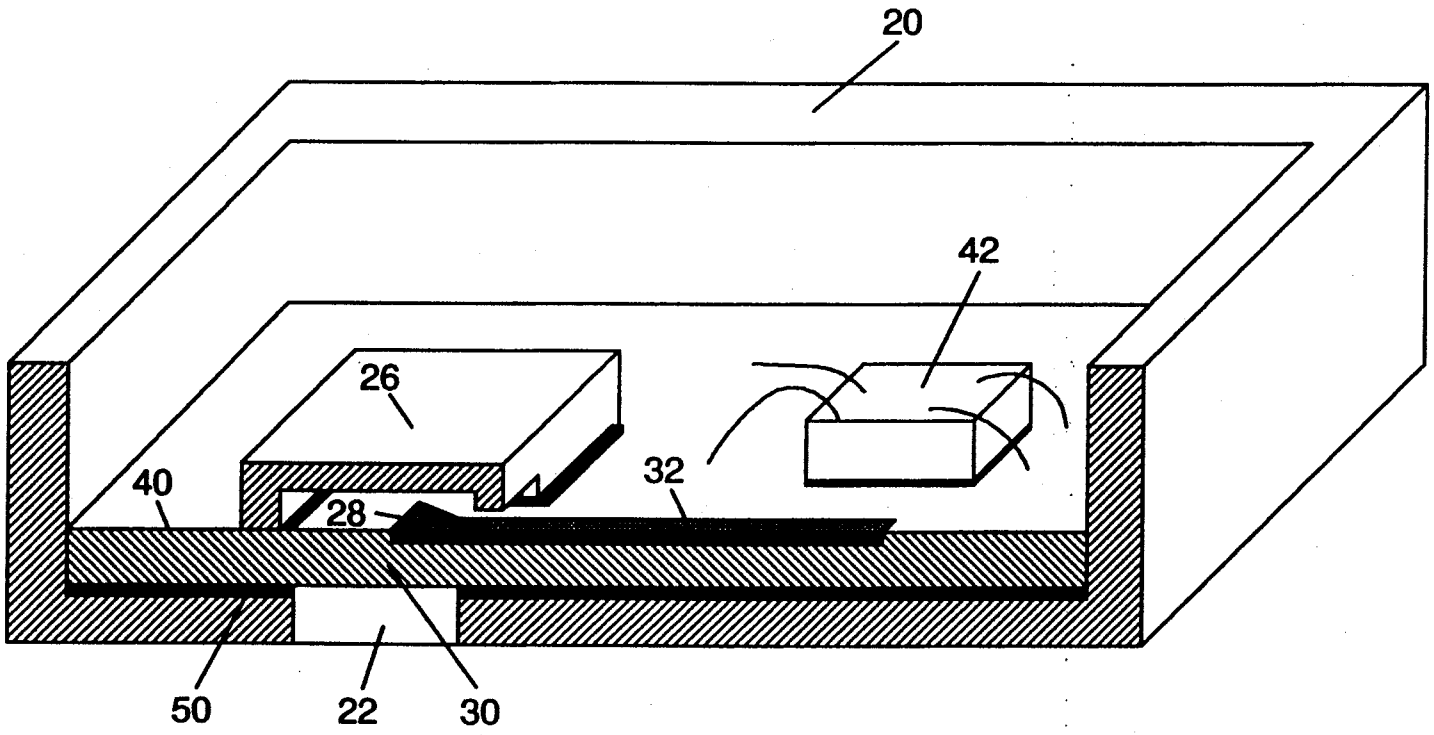
FIG. 1 is a sectional view showing the interior of the invention with the top removed.

Millimeter wave, high performance transceivers need a structure for capturing millimeter electromagnetic signals and transmitting the energy in those signals to processing circuitry. The invention provides a design which can be readily mass produced at lower costs than presently available alternatives.

A housing 20 (FIG. 1) may be cast or machined to a desired shape. Housing 20 includes a waveguide 22 for capturing electromagnetic signals 24. The electromagnetic signals 24 move through the waveguide 22 and hermetic seal 30, are reflected by the backshort 26 (FIG. 2), and are sensed by the antenna 28. Antenna 28 transmits the electromagnetic signal 24 to microstrip 32 for processing by electronic circuitry.

Figure 2:
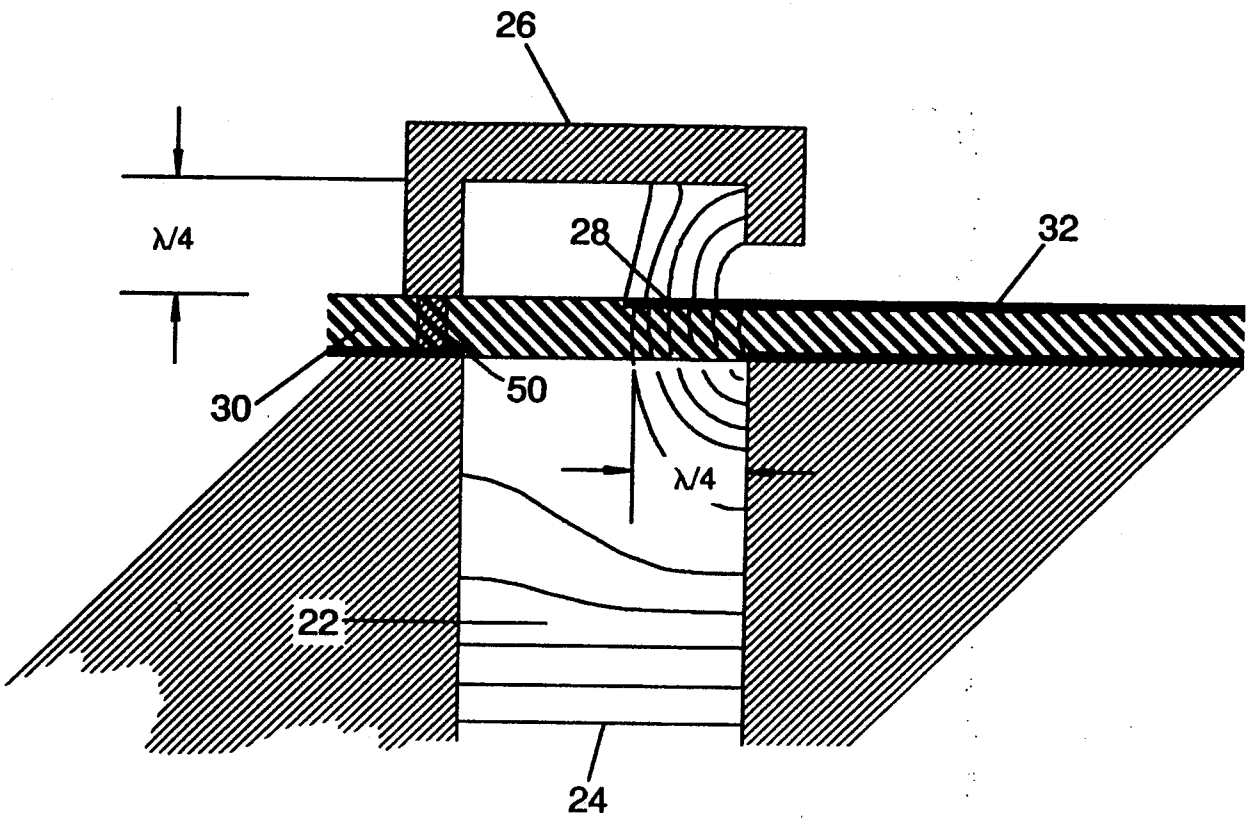
FIG. 2 is a side, sectioned view of the invention illustrating the capture of electromagnetic signals for transmission to a microstrip.

Manufacturing the invention may be segmented so the parts are individually formed and then later assembled into a completed module. A flat base 34 (FIG. 3) is formed with voids 36 which will serve as waveguide 22 (FIG. 1). A sidewall 38 (FIG. 3) defines the boundary of the invention's housing 20 (FIG. 1) when the sidewall 38 (FIG. 3) is later bonded to base 34.

Figure 3:
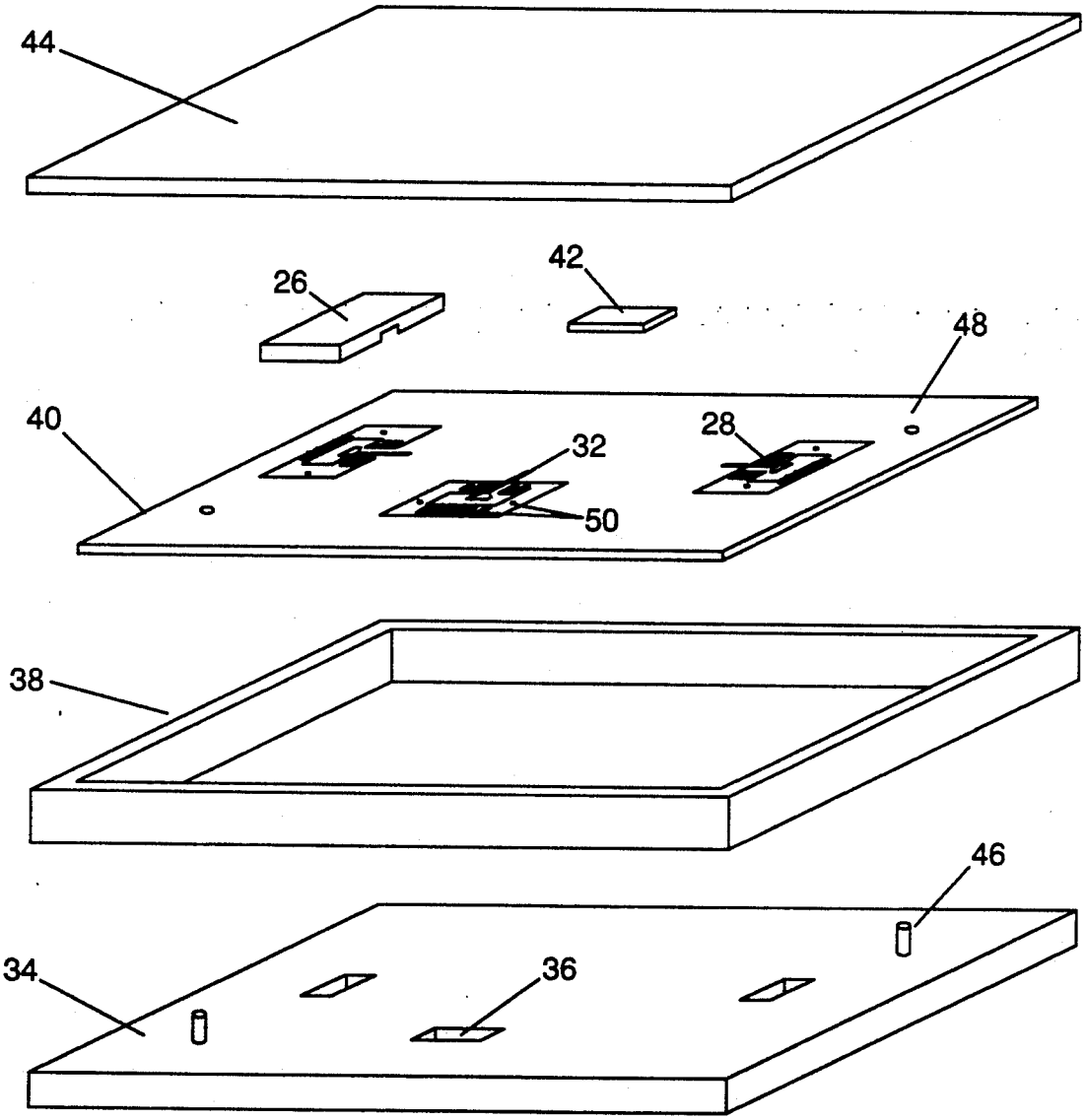
FIG. 3 is an exploded view of the invention showing the assembly of the invention components.

Circuit board 40 includes millimeter wave circuits 42 used to process captured electromagnetic signals 24 (FIG. 2) captured in waveguide 22, reflected off backshorts 26 bonded to base 34 and opposite each waveguide 22, and detected by antenna 28 (FIG. 3). Antenna 28 and microstrip 32 are bonded to circuit board 40 at a position which will correspond to the void 36 in base 34. Circuit board 40 provides the environmental barrier between the environment outside housing 20 (FIG. 1) and the millimeter wave electronic circuits 42 inside housing 20 when circuit board 40 is hermetically sealed to base 34, sidewall 38, and cover 44. Such sealing prevents environmental elements such as dust and moisture from invading the interior of housing 20 and degrading the housed components.

The various parts of the invention may be located for assembly by locator pins 46 (FIG. 3) engaging complimenting locator pin receptacles 48 in the circuit board 40 to properly align the circuit board 40 with base 34. Vias 50 (FIG. 1) serve to position backshorts 26 and act as electromagnetic shorts between waveguides 22 and backshorts 26 through circuit board 40. Vias 50 terminate in base 34 to retain the hermetic seal between the atmosphere and circuit board 40.

Antenna 28 is designed for a broadband match with waveguide 22. The vias 50 and assembly process result in a repeatable waveguide input impedence so no tuning is required for the modules's optimum performance. The broadbandedness of the antenna 28 makes the invention tolerant to normal machining and assembly tolerance. The hermetic seal of the invention may be achieved by using silver epoxy, solder, or an eutectic bond for the components in the invention's module.

I claim:

1. A waveguide-to-microstrip transition module for transmitting captured electromagnetic energy between a waveguide and signal processing circuitry, the module comprising:

a base including at least one waveguide through which said electromagnetic energy is transmitted into the module to the signal processing circuitry, said at least one waveguide locatable anywhere on said base;

a circuit board having one continuous side hermetically sealed to the base and the opposite side including at least one microstrip connected to signal processing circuitry and cooperatively oriented with said at least one waveguide;

at least one backshort, mounted on said opposite side of the circuit board, said backshort cooperatively associated with said at least one waveguide and said at least one microstrip;

a housing containing the base and circuit board; and a cover hermetically sealed to the housing to enclose the circuit board in the housing.

2. The waveguide-to-microstrip transition module of claim 1, wherein the base includes means for aligning the base with the circuit board so said at least one microstrip is cooperatively oriented with said at least one waveguide.

3. The waveguide-to-microstrip transition module of claim 2, wherein the means for aligning the base with the circuit board comprises locator pins in the base which engage complementary receptacles in the circuit board so said at least one microstrip is cooperatively oriented with said at least one waveguide.

4. The waveguide-to-microstrip transition module of claim 1, wherein the circuit board includes vias aligned with said at least one waveguide, the vias effectively extending boundaries of the waveguide in the base through the circuit board and to the backshort associated with said at least one microstrip.

5. The waveguide-to-microstrip transition module of claim 1, wherein each backshort is mounted on the circuit board and independent of the housing.

6. The waveguide-to-microstrip transition module of claim 1, wherein the housing is bonded to the base and circuit board.

* * * * *